US007690724B2

(12) United States Patent
Tanizawa et al.

(10) Patent No.: US 7,690,724 B2
(45) Date of Patent: Apr. 6, 2010

(54) MESSAGE CHAIR

(75) Inventors: Takayoshi Tanizawa, Higashiomi (JP); Satoshi Kajiyama, Hikone (JP); Masamichi Miyaguchi, Hikone (JP); Daisuke Tsukada, Hikone (JP); Fumihiro Nishio, Hikone (JP); Takeo Iijima, Hikone (JP); Yuichi Nishibori, Hikone (JP)

(73) Assignee: Panasonic Electric Works Co. Ltd., Kadoma-shi (JP)

( * ) Notice: Subject to any disclaimer, the term of this patent is extended or adjusted under 35 U.S.C. 154(b) by 0 days.

(21) Appl. No.: 11/802,666

(22) Filed: May 24, 2007

(65) Prior Publication Data

US 2007/0273187 A1 Nov. 29, 2007

(30) Foreign Application Priority Data

May 26, 2006 (JP) ..... 2006-147375

(51) Int. Cl.
*A47C 1/024* (2006.01)
*A47C 7/72* (2006.01)
*A47C 7/62* (2006.01)

(52) U.S. Cl. ..... 297/217.3; 297/217.1; 297/330

(58) Field of Classification Search ..... 297/217.3, 297/217.1, 330
See application file for complete search history.

(56) References Cited

U.S. PATENT DOCUMENTS 6,065,806 A * 5/2000 Miyaguchi et al. .... 297/217.3 X
6,974,186 B1 * 12/2005 Chang ..... 297/68
7,293,839 B2 * 11/2007 Shimizu ..... 297/423.36
7,452,032 B1 * 11/2008 Roleder et al. ..... 297/330
2002/0084682 A1 * 7/2002 Collins ..... 297/330
2002/0163229 A1 * 11/2002 Schefthaler ..... 297/68
2003/0025366 A1 * 2/2003 Barreiro, Jr. ..... 297/217.3
2004/0004376 A1 * 1/2004 Cabebe ..... 297/217.1

(Continued)

FOREIGN PATENT DOCUMENTS

EP 1 537 845 A1 6/2005

(Continued)

OTHER PUBLICATIONS

Japanese Office Action, Sep. 16, 2008, issued in JP2006-147375.

(Continued)

*Primary Examiner*—Rodney B White
(74) *Attorney, Agent, or Firm*—Edwards Angell Palmer & Dodge LLP

(57) ABSTRACT

A massage chair including an electric reclining mechanism for moving a backrest into different sloping positions, a holding mechanism for holding at least one forearm of a user to fix to the base side, and a controller that controls operations of these mechanisms. The controller allows the holding mechanism to hold the at least one forearm and allows the electric reclining mechanism to move the backrest into at least one sloping position before moving the backrest into a final position. An inclination of the at least one sloping position from a sloping position of the different sloping positions when the at least one forearm is held by the holding mechanism is smaller than an inclination of the end position from a sloping position of the different sloping positions when the at least one forearm is held by the holding mechanism.

6 Claims, 5 Drawing Sheets

U.S. PATENT DOCUMENTS

| | | | | |
|---|---|---|---|---|
| 2005/0088028 | A1* | 4/2005 | Wan et al. | 297/440.1 |
| 2005/0146176 | A1* | 7/2005 | Yoda et al. | 297/217.1 |
| 2006/0001297 | A1* | 1/2006 | Chang | 297/75 |
| 2007/0120408 | A1* | 5/2007 | Hsieh | 297/411.39 |
| 2007/0273180 | A1* | 11/2007 | Tanizawa et al. | 297/85 |
| 2008/0030053 | A1* | 2/2008 | Kamba et al. | 297/217.3 |
| 2008/0048475 | A1* | 2/2008 | Tanizawa et al. | 297/284.6 |
| 2008/0122283 | A1* | 5/2008 | Yoda et al. | 297/423.26 |
| 2008/0252116 | A1* | 10/2008 | Phillips | 297/217.1 |

FOREIGN PATENT DOCUMENTS

| | | |
|---|---|---|
| JP | 2003-210270 | 7/2003 |
| JP | 2005-13463 | 1/2005 |
| JP | 2005-152260 | 6/2005 |
| JP | 2005-342339 | 12/2005 |

OTHER PUBLICATIONS

Japanese Office Action, Dec. 16, 2008, issued in JP2006-147375.
Chinese Office Action dated Sep. 25, 2009 issued in Chinese Patent Application No. 2007101045423.

* cited by examiner

MESSAGE CHAIR

BACKGROUND OF THE INVENTION

1. Field of the Invention

The invention relates generally to massage chairs and, more particularly, to a massage chair that uses reclining movement of a backrest for stretching user's arms.

2. Description of the Related Art

Such a massage machine is described in, for example, Japanese Patent Application Publication No. 2005-013463 issued Jan. 20, 2005. This machine (hereinafter referred to as a "first prior art") uses an electric reclining mechanism of a backrest to obtain a stretching (extension) effect on the user's arms. That is, the first prior art swells left and right airbags located at each of left and right armrests to hold each forearm of the user with each left and right airbags, and moves the backrest into a final position from a start position to lean the upper part of the user's body backward. The start position is a sloping position, and the end position is a sloping position that has an inclination larger than the start position with respect to the vertical direction. While holding each forearm with each left and right airbags, the first prior art repeatedly drives the electric reclining mechanism so that the backrest is moved into the final position and returned to the start position (initial angle).

Another massage machine described in Japanese Patent Application Publication No. 2005-152260 issued Jun. 16, 2005 also uses an electric reclining mechanism of a backrest to obtain a stretch effect on the user's arms and shoulders. This machine (hereinafter referred to as a "second prior art") swells upper and lower airbags located at each of left and right arm rests to hold each hand and forearm of the user with each upper and lower airbags, and moves the backrest into a final position from a start position to lean the upper part of the user's body backward. In case of a first operational example, the second prior art moves the backrest into the final position while swelling the airbags of the armrests; returns the backrest to the start position after the airbags finish swelling; and shrinks the airbags after holding each swollen condition of the airbags for a specified time. In case of a second operational example, the second prior art swells the airbags of the armrests; moves the backrest into the final position after the airbags finish swelling; and returns the backrest to the start position while shrinking the airbags after holding each swollen condition of the airbags for a specified time.

However, each of the first and second prior arts moves its backrest into final position from a start position without stopping, and therefore uses strength in response to the final position to pull the user's arms without stopping.

SUMMARY OF THE INVENTION

It is an object of the present invention to use an electric reclining mechanism to stretch at least one arm of a user more softly than the first and second prior arts each of which moves its backrest into a final position without stopping.

A massage chair of the present invention comprises a base, a reclining backrest, an electric reclining mechanism, a holding mechanism and a controller. The base includes a seat. The reclining backrest is located at the back of the base. The electric reclining mechanism is configured to move the backrest into different sloping positions. The holding mechanism is configured to hold at least one forearm of a user to restrain the at least one forearm to the base side. The controller is configured to control operations of the electric reclining mechanism and the holding mechanism. According to an aspect of the invention, the controller allows the holding mechanism to hold the at least one forearm and allow the electric reclining mechanism to move the backrest into at least one sloping position before moving the backrest into a final position. The at least one sloping position and the final position are included in the different sloping positions. An inclination of the at least one sloping position from a sloping position of the different sloping positions when the at least one forearm is held by the holding mechanism is smaller than an inclination of the final position from a sloping position of the different sloping positions when the at least one forearm is held by the holding mechanism.

In this construction, because the massage chair moves the backrest into the at least one sloping position before moving the backrest into a final position, the user can warm up before the at least one forearm is moved into the final position. As a result, it is possible to stretch at least one arm of the user more softly than the first and second prior arts each of which moves its backrest into a final position without stopping.

In a modified embodiment, the massage chair has separate left and right holding mechanisms. The left and right holding mechanisms are configured to hold at least left and right forearms of the user to restrain the at least left and right forearms to the base side, respectively. The controller allows the left holding mechanism to hold the at least left forearm and also allows the right holding mechanism to hold the at least right forearm. In this construction, for example, it is possible to stretch the users arms alternately or simultaneously more softly than the first and second prior arts.

In a preferred embodiment, the controller allows the electric reclining mechanism to perform a stretching operation while also allowing the left and right holding mechanisms to hold the at least left and right forearms separately or simultaneously. The stretching operation is comprised of unit operations repeated a specified number of times. Each of the unit operations includes an operation that moves the backrest into a second sloping position from a first sloping position and afterwards moves the backrest into a third sloping position. The first, second and third sloping positions of the stretching operation are included in the different sloping positions. Each second sloping position of the stretching operation has an inclination larger than the first sloping position in the same unit operation with respect to the vertical direction. Each third sloping position of the stretching operation has an inclination smaller than the second sloping position in the same unit operation with respect to the vertical direction. An angle between a series of first and second sloping positions is smaller than an angle between the succeeding series of first and second sloping positions. In this construction, the user's arms can be stretched effectively.

In an enhanced embodiment, the massage chair further comprises left and right armrests. The left holding mechanism comprises: a left cover that is located above the left armrest and covers the at least left forearm; at least one first airbag located at the left armrest and/or the left cover; and an air supply pump for swelling the first airbag. The right holding mechanism comprises: a right cover that is located above the right armrest and covers the at least right forearm; at least one second airbag located at the right armrest and/or the right cover; and said air supply pump for swelling the second airbag. When holding the at least left forearm, the controller causes the first airbag to swell through the air supply pump in order to hold the at least left forearm with the first airbag, the left armrest and the left cover. When holding the at least right forearm, the controller causes the second airbag to swell through the air supply pump in order to hold the at least right forearm with the second airbag, the right armrest and the right cover.

Preferably, in each unit operation of the stretching operation, the controller holds the at least left forearm with the first airbag, the left armrest and the left cover and then increases the holding force by the first airbag and allowing the electric reclining mechanism to move the backrest from the first sloping position to the second sloping position in the existing unit operation. The controller also holds the at least right forearm with the second airbag, the right armrest and the right cover and then increases the holding force by the second airbag as allowing the electric reclining mechanism to move the backrest from the first sloping position to the second sloping position in the existing unit operation. In this construction, the at least left and right forearms can be held properly with the first and second airbags, respectively, without applying excessive force during the stretching operation.

BRIEF DESCRIPTION OF THE DRAWINGS

Preferred embodiments of the invention will now be described in further details. Other features and advantages of the present invention will become better understood with regard to the following detailed description and accompanying drawings where.

DETAILED DESCRIPTION OF EXEMPLARY EMBODIMENTS

Figure 1:
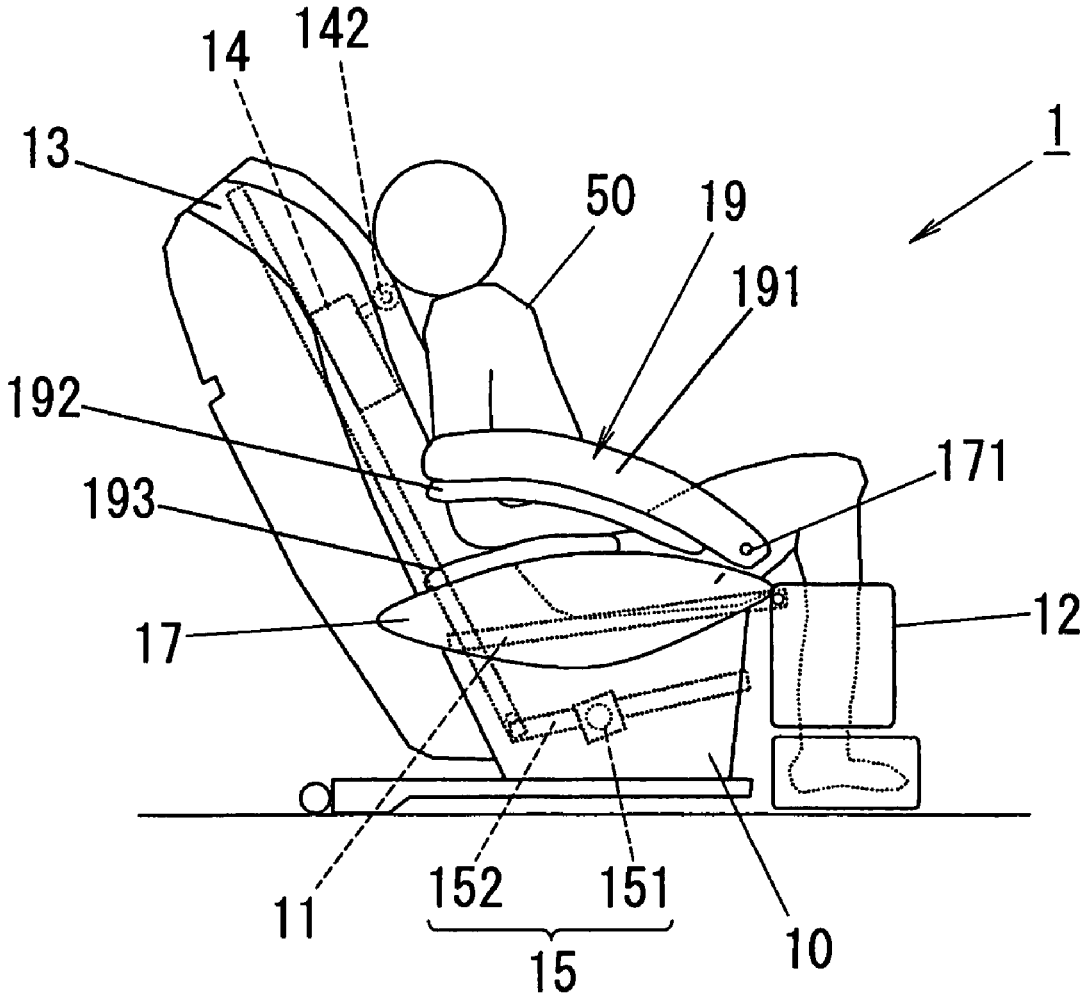
FIG. 1 is a schematic diagram of an embodiment according to the present invention seen from the right side.
Figure 2:
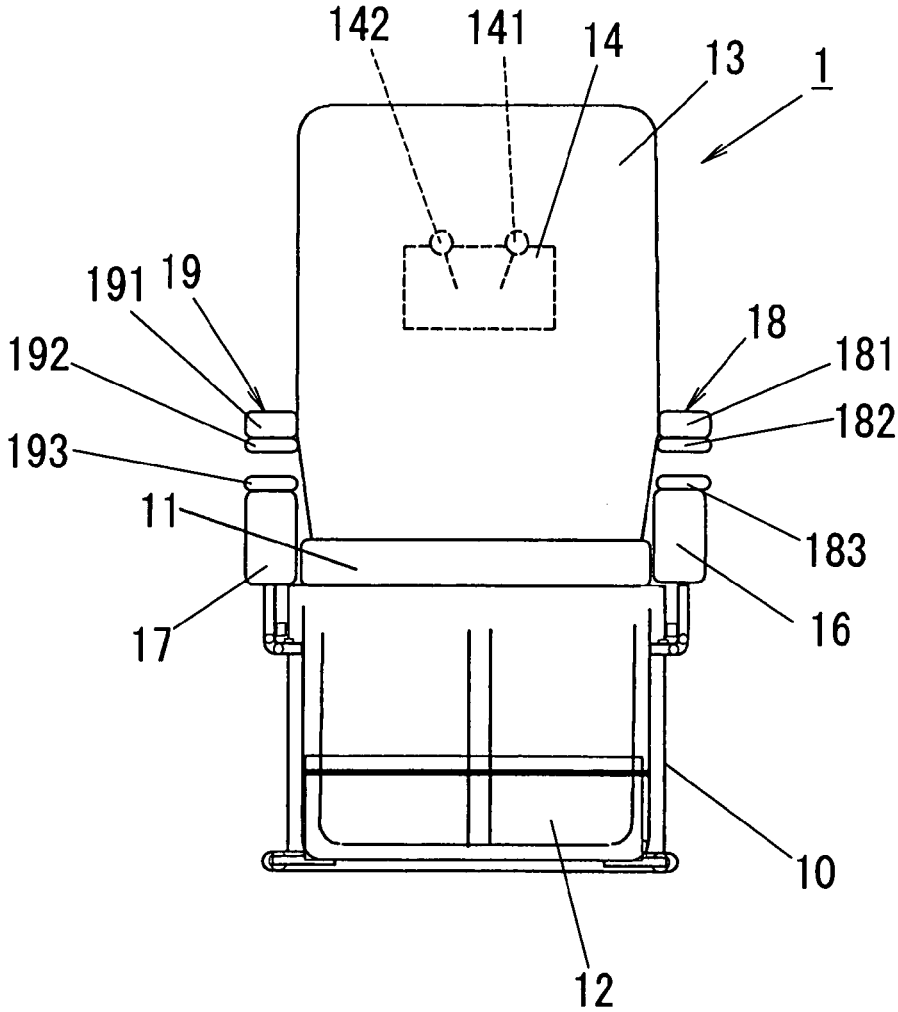
FIG. 2 is a schematic diagram of the embodiment seen from the front side.
Figure 3:
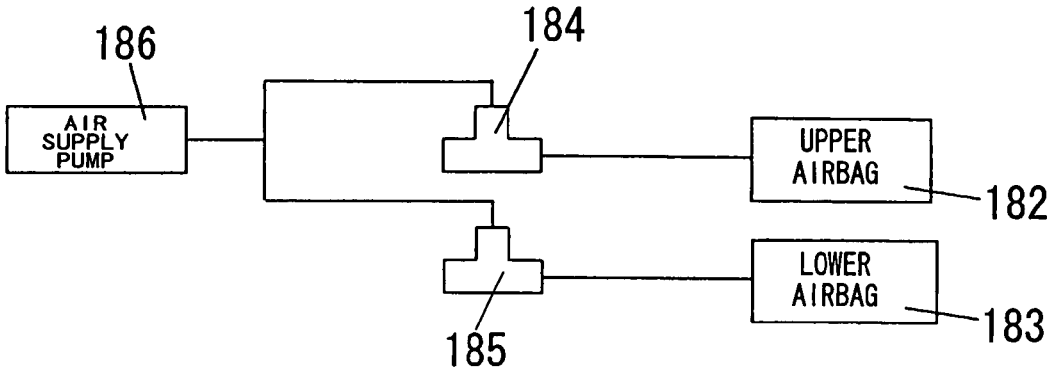
FIG. 3 is an explanatory diagram of a left holding mechanism in the embodiment.
Figure 4:
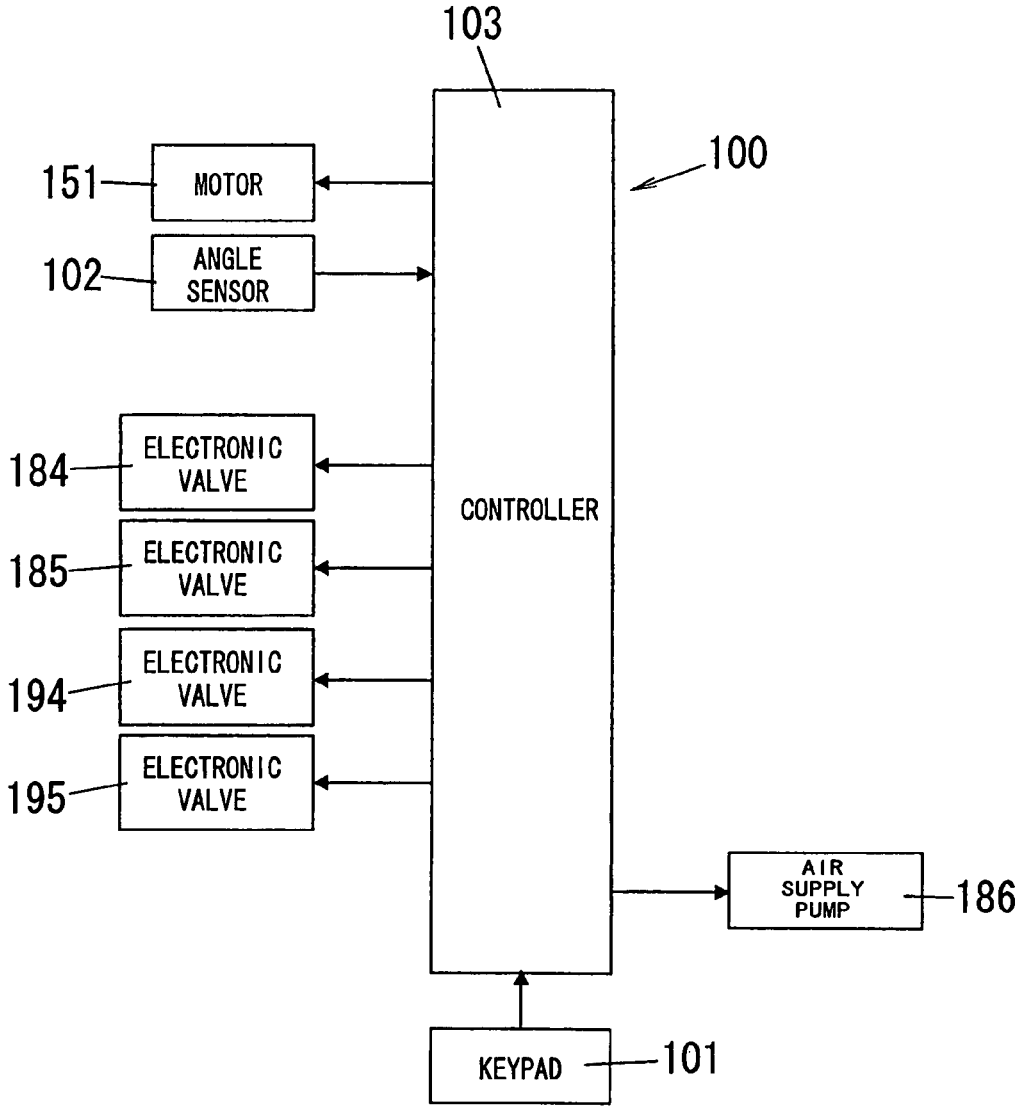
FIG. 4 is a block diagram of a drive system in the embodiment.

FIGS. 1 and 2 show an embodiment according to the present invention, namely a massage chair 1. For example, this chair 1 comprises a base 10, a leg/foot rest 12, a reclining backrest 13, a massage mechanism 14, an electric reclining mechanism 15, left and right armrests 16 and 17, left and right holding mechanisms 18 and 19, and a drive system 100 (see FIG. 4). The base 10 includes a seat 11. The leg/foot rest 12 is configured so as to be supported by at least one axis fixed to the base 10 to rise and fall by rotating about the axis through an electric elevating mechanism (not shown) put in the base 10. This mechanism is well known to those skilled in the art and therefore is not described in detail herein.

The backrest 13 is located at the back of the base 10 and can be reclined to different sloping positions such as sitting position, full reclining position and so on through the electric reclining mechanism 15 constructed of a motor 151 and a link mechanism 152 in the same way as conventional massage chairs. In this embodiment, the backrest 13 can be reclined to any of eight sloping positions equally divided in the reclining direction. The massage mechanism 14 is an elevating massage mechanism located in the backrest 13, and has left and right massage heads (e.g., kneading balls) 141 and 142 that simulate massage movement (e.g., kneading and tapping) to give a user a massage in accordance with control of the drive system 100. In general, the massage mechanism 14 is driven after the backrest 13 is moved into a desired sloping position through a sloping-position adjusting key (not shown).

As shown in FIGS. 1-4, the left and right armrests 16 and 17 are installed at the left and right sides of the base 10 and are provided with the left and right holding mechanisms 18 and 19, respectively. The left holding mechanism 18 includes a left cover 181, upper and lower airbags (first airbags) 182 and 183, electronic valves 184 and 185, and an air supply pump 186. The cover 181 is formed so as to cover the user's left hand and forearm, and is supported by an axis fixed to the front of the left armrest 16 to move upward and downward in the upside of the armrest 16 by rotating about the axis. In addition, for example, by an electric mechanism (not shown), the cover 181 can be moved into a predetermined angle in a specified range and then be locked. The airbag 182 is installed on the bottom face of the cover 181 and is coupled to the pump 186 or the atmosphere through the electronic valve 184, while the airbag 183 is installed on the top face of the armrest 16 and is coupled to the pump 186 or the atmosphere through the electronic valve 185. The electronic valve 184 is driven by the drive system 100 to couple the airbag 182 to the pump 186 and the atmosphere in case of air supply and exhaust, respectively. The electronic valve 185 is also driven by the drive system 100 to couple the airbag 183 to the pump 186 and the atmosphere in case of air supply and exhaust, respectively. The pump 186 is driven by the drive system 100.

Similarly, the right holding mechanism 19 includes a right cover 191, upper and lower airbags (second airbags) 192 and 193, electronic valves 194 and 195, and the air supply pump 186. However, not limited to this, the right holding mechanism 19 may comprise another air supply pump instead of the pump 186. Each airbag of the left and right holding mechanisms 18 and 19 is formed from flexible materials and has airtightness. The cover 191 is formed so as to cover the user's right hand and forearm, and is supported by an axis 171 fixed to the front of the right armrest 17 to move upward and downward in the upside of the armrest 17 by rotating about the axis 171. In addition, for example, by an electric mechanism (not shown), the cover 191 can be moved into a predetermined angle in a specified range and then be locked. However, not limited to these, the covers 181 and 191 may be fixed to the left and right armrests 16 and 17 at a predetermined angle, respectively. The airbag 192 is installed on the bottom face of the cover 191 and is coupled to the pump 186 or the atmosphere through the electronic valve 194, while the airbag 193 is installed on the top face of the armrest 17 and is coupled to the pump 186 or the atmosphere through the electronic valve 195. The electronic valve 194 is driven by the drive system 100 to couple the airbag 192 to the pump 186 and the atmosphere in case of air supply and exhaust, respectively. The electronic valve 195 is also driven by the drive system 100 to couple the airbag 193 to the pump 186 and the atmosphere in case of air supply and exhaust, respectively. However, the left and right holding mechanisms of the present invention may be configured to hold the user's left and right forearms, respectively, in the same way as, for example, the first prior art.

Figure 5:
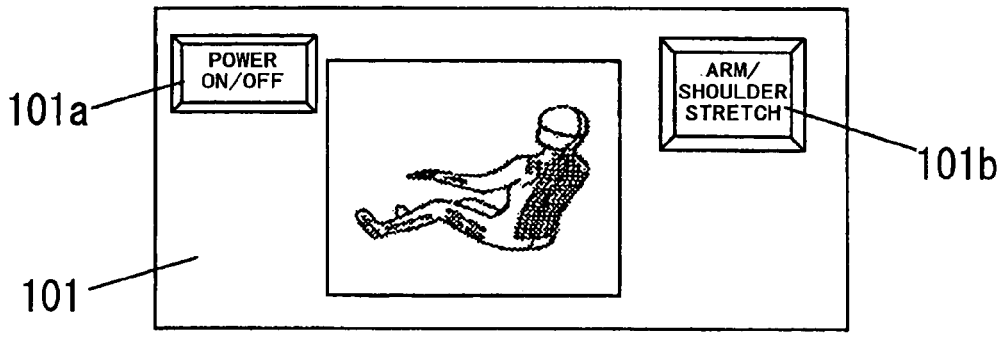
FIG. 5 is an explanatory diagram of a keypad in the embodiment.
Figure 6A:
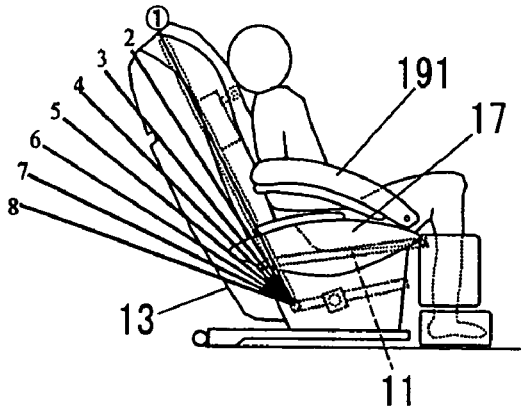
FIGS. 6A-6D are explanatory diagrams of a stretching operation of the embodiment.
Figure 6B:
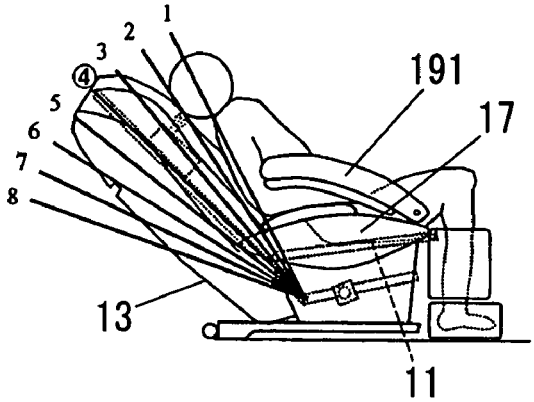
Figure 6C:
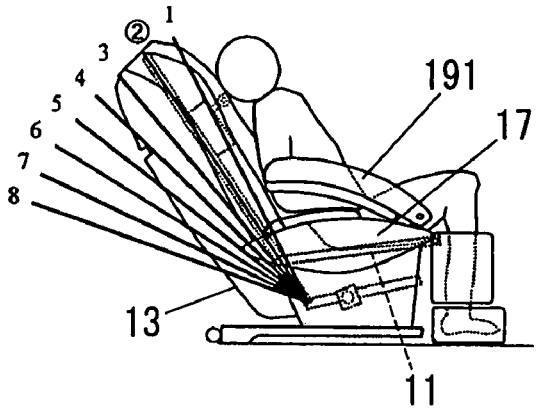
Figure 6D:
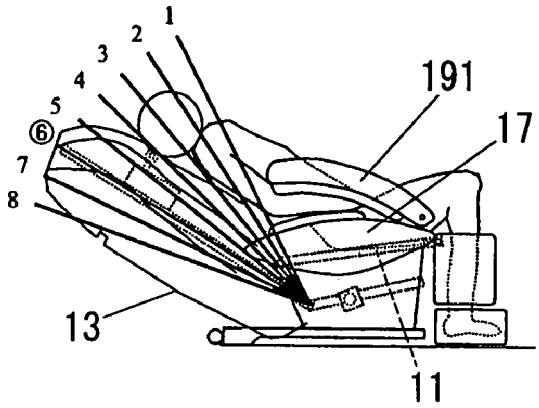

The drive system 100 comprises a keypad 101 as an input means, an angle sensor 102, a controller 103 and so on. As shown in FIG. 5, the keypad 101 comprises various keys such as a power on/off key 101*a*, an arm/shoulder stretch key 101*b* and so on in addition to the above sloping-position adjusting key. The angle sensor 102 is configured to detect the angle of a sloping position of the backrest 13. The controller 103 is, for example, constructed of one or more microcomputers, a storage device and so on, and has various programs, data on angles of the different sloping positions and so on. This controller 103 controls operations of different mechanisms based on different instructions obtained from the keypad 101, detection result of the angle sensor 102 and so on. The different mechanisms include the electric elevating mechanism of the leg/foot rest 12, the elevating massage mechanism, the electric reclining mechanism 15, the left and right holding mechanisms 18 and 19 and so on.

In addition to various controls executed in the same way as conventional massage chairs, the controller 103 provides the control for stretching the user's arms and shoulders according to an aspect of the embodiment when the key 101*b* is pressed after switch-on by pressing the key 101*a*. That is, the controller 103 moves the covers 181 and 191 into the predetermined angle to lock the covers 181 and 191 through the electric mechanisms of the left and right holding mechanisms 18 and 19, respectively. Afterwards, the controller 103 allows the left and right holding mechanisms 18 and 19 to hold the at least one forearm of the user. In the embodiment, the left and right holding mechanisms 18 and 19 hold at least one hand and forearm as a result of their structure. Expanding on this control, when holding the user's left hand and forearm, the controller 103 causes the airbags 182 and 183 to swell through the electronic valves 184 and 185 and the pump 186 to hold the left hand and forearm elastically with the airbags 182 and 183. When holding the right hand and forearm, the controller 103 causes the airbags 192 and 193 to swell through the electronic valves 194 and 195 and causes the pump 186 to hold the right hand and forearm elastically with the airbags 192 and 193.

Afterwards, as shown in FIGS. 6A-6D, the controller 103 allows the electric reclining mechanism 15 to move the backrest 13 into at least one sloping position before moving the backrest 15 into a final position based on detection result of the angle sensor 102. The at least one sloping position and the final position are included in the above different sloping positions 1-8. An inclination of the at least one sloping position from a sloping position of the different sloping positions when the at least one hand and forearm are held is smaller than an inclination of the end position from a sloping position of the different sloping positions when the at least one hand and forearm are held.

In the embodiment, the controller 103 allows the electric reclining mechanism 15 to perform a stretching operation while allowing the left and right holding mechanisms 18 and 19 to hold the left and right hands and forearms separately. The stretching operation is comprised of unit operations repeated a specified number of times (e.g., twice). Each of the unit operations includes an operation that moves the backrest 13 into a second sloping position from a first sloping position and afterwards moves the backrest 13 into a third sloping position. The first, second and third sloping positions of the stretching operation are included in the different sloping positions 1-8. Each second sloping position (e.g. "4" in FIG. 6B or "6" in FIG. 6D) of the stretching operation has an inclination larger than the first sloping position (e.g., "1" in FIG. 6A or "2" in FIG. 6C) in the same unit operation with respect to the vertical direction. Each third sloping position (e.g., "2" in FIG. 6C or "1" in FIG. 6A) of the stretching operation has an inclination smaller than the second sloping position in the same unit operation with respect to the vertical direction. In short, an angle between a series of first and second sloping positions is smaller than an angle between the succeeding series of first and second sloping positions. However, not limited to this, the controller 103 may allow the electric reclining mechanism 15 to perform the stretching operation while also allowing the left and right holding mechanisms 18 and 19 to hold the left and right hands and forearms simultaneously.

In addition, the controller 103 increases the holding force caused by the first or second airbags by allowing the electric reclining mechanism 15 to move the backrest 13 from the first sloping position to the second sloping position in the existing unit operation. The controller 103 also utilizes the airbags 182, 183, 192 and 193 as a massage means. In this case, the controller 103 swells and shrinks at least one of the airbags 182, 183, 192 and 193 while driving the pump 186.

Figure 7:
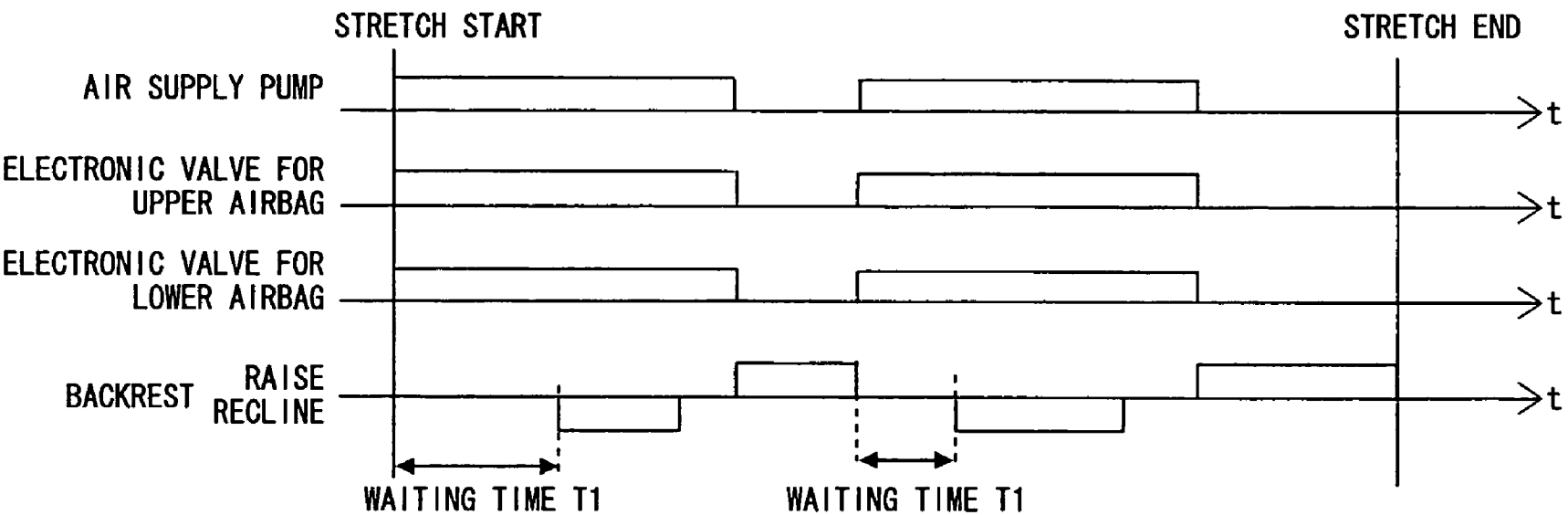
FIG. 7 is a time chart of the stretching operation.

The operation of the massage chair 1 is now explained with reference to FIG. 7 as follows. When the key 101*b* is pressed after switch-on by pressing the key 101*a*, the controller 103 moves the covers 181 and 191 into the predetermined angle to lock the covers 181 and 191 through the electric mechanisms of the left and right holding mechanisms 18 and 19, and then starts and repeats the stretching operation.

In each stretching operation, first, the controller 103 provides the control for stretching one side of the user's arms and shoulders. For example, the controller 103 swells the airbags 182 and 183 through the electronic valves 184 and 185 and the pump 186. At this point, the controller 103 drives the electronic valves 184 and 185 to couple the airbags 182 and 183 to the pump 186, and also drives the pump 186. After a waiting time T1, the controller 103 moves the backrest 13 into a second sloping position ("4" in FIG. 6B) from a first sloping position ("1" in FIG. 6A) at a constant speed through the electric reclining mechanism 15. This first sloping position becomes a start position of the existing stretching operation. At this point, the controller 103 dives the motor 151 so a that detection result of the angle sensor 102 agrees with the angle of an objective sloping position stored in the storage device of the controller 103. After a few seconds from a point in time at which the backrest 13 reaches the second sloping position, the controller 103 shrinks the airbags 182 and 183 through the electronic valves 184 and 185 and the pump 186. At this point, the controller 103 drives the electronic valves 184 and 185 to couple the airbags 182 and 183 to the atmosphere, and also stops the pump 186. The controller 103 also starts moving the backrest 13 into a third sloping position ("2" in FIG. 60) as a return position from the second sloping position at a constant speed through the electric reclining mechanism 15. This third sloping position is used as a first sloping position of a second unit operation.

When the backrest 13 reaches the third sloping position, the controller 103 starts the second unit operation and then swells the airbags 182 and 183 through the electronic valves 184 and 185 and the pump 186. After a waiting time T1, the controller 103 moves the backrest 13 into a second sloping position ("6" in FIG. 6D) from a first sloping position ("2" in FIG. 60) at a constant speed through the electric reclining mechanism 15. This second sloping position becomes a final position of the existing stretching operation, whereas the second sloping position of the first unit operation becomes an intermediate position of the existing stretching operation. Because if the first sloping positions of the first and second unit operations are matched each other, the second sloping position of the first unit operation is located between the first and second sloping positions of the second unit operation. Every time T1 is set to a time necessary to hold one hand and forearm securely with the corresponding airbags. After few seconds from a point in time at which the backrest 13 reaches the second sloping position in the second unit operation, the controller 103 shrinks the airbags 182 and 183 through the electronic valves 184 and 185 and the pump 186. The controller 103 also starts moving the backrest 13 into a third sloping position ("1" in FIG. 6A) from the second sloping position at a constant speed through the electric reclining mechanism 15. Preferably, this speed is set to a slower speed than the former speed and thereby it is possible to stretch the corresponding arm and shoulder slowly and effectively. The third sloping position is used as a first sloping position (start position) later on. When the backrest 13 reaches the third sloping position, the control for stretching one side of the user's arms and shoulders is completed.

Similarly, the controller 103 provides the control for stretching the other side of the user's arms and shoulders. However, not limited to this, the controller 103 may provide the control for stretching the user's arms and shoulders simultaneously.

In this embodiment, because the massage chair 1 moves the backrest 13 into, for example, the second sloping position ("4") before moving the backrest 13 into the second sloping position ("6") as an end position, the user can warm up before the arms and shoulders are moved into the end position separately. As a result, it is possible to stretch the user's arms and shoulders more gently than the first and second prior arts, each of which moves its backrest into an end position without stopping. Also, because the backrest 13 is kept at the second sloping position ("4") for few seconds, light stretching effect can be obtained in addition to the warm-up. Moreover, as shown in FIG. 7, after holding a user's one hand and forearm securely with the corresponding airbags, the controller 103 increases a holding force by the corresponding airbags by allowing the electric reclining mechanism 15 to move the backrest 13 from the first sloping position to the second sloping position in the existing unit operation. Accordingly, the left and right hands and forearms can be held properly with the first and second airbags, respectively, without applying excessive force during the stretching operation.

In a modified embodiment, the controller 103 is configured to swell one of the airbags 182 and 183 when holding the user's left hand and forearm, and to also swell one of the airbags 192 and 193 when holding the right hand and forearm. However, not being limited to this, the left mechanism 18 may be provided with an upper or lower airbag and a lower or upper cushion instead of the airbags 182 and 183, and also the right mechanism 19 may be provided with an upper or lower airbag and a lower or upper cushion instead of the airbags 192 and 193. In short, the left holding mechanism of the present invention may comprise: a left cover that is located above the left armrest 16 and covers at least the left forearm of a user; at least one first airbag located at the left armrest and/or the left cover; and an air supply pump for swelling the first airbag. Similarly, the right holding mechanism of the present invention may comprise: a right cover that is located above the right armrest 17 and covers at least the right forearm of the user; at least one second airbag located at the right armrest and/or the right cover; and the previously-mentioned air supply pump or another air supply pump for swelling the second airbag.

In another modified embodiment, the controller 103 is configured to stop the pump 186 immediately after the backrest 13 reaches a second sloping position and, after few seconds, drive the corresponding electronic valves to couple the corresponding airbags to the atmosphere. In this construction, immediately after the backrest 13 reaches a second sloping position, increase of holding force by the corresponding airbags can be stopped, and holding force when the backrest 13 reaches the second sloping position can be kept for few seconds.

Although the present invention has been described with reference to certain preferred embodiments, numerous modifications and variations can be made by those skilled in the art without departing from the true spirit and scope of this invention.

The invention claimed is:

1. A massage chair, comprising:

a base including a seat;

at least one armrest fixed to the base a reclining backrest located at the back of the base;

an electric reclining mechanism for moving the backrest into different sloping positions;

a holding mechanism for holding at least one forearm of a user to restrain the at least one forearm to the at least one armrest; and a controller that controls operations of the electric reclining mechanism and the holding mechanism, the controller controlling the holding mechanism and using a specified number of repeated unit operations that control the reclining mechanism to recline the backrest to a first angle and then to a second angle, wherein the controller controls the reclining mechanism:

(i) to allow the electric reclining mechanism to move the backrest into at least one sloping position at the first angle to provide warm-up for the user, while allowing the holding mechanism to hold the at least one forearm to the at least one armrest in a fixed position so as to restrain the at least one forearm; and subsequently (ii) to allow the electric reclining mechanism to move the backrest into a final position at the second angle to provide arm stretch for the user, while allowing the holding mechanism to hold the at least one forearm to the at least one armrest in a fixed position so as to restrain the at least one forearm, the at least one sloping position and the final position being included in the different sloping positions, the first angle being smaller than the second angle.

2. The massage chair of claim 1, having left and right holding mechanisms, the left and right holding mechanisms being for holding at least left and right forearms of the user to restrain the at least left and right forearms to the base side, respectively, wherein the controller allows the left holding mechanism to hold the at least left forearm and also allows the right holding mechanism to hold the at least right forearm.

3. The massage chair of claim 2, wherein the controller allows the electric reclining mechanism to perform a stretching operation while also allowing the left and right holding mechanisms to hold the at least left and right forearms separately or simultaneously, the stretching operation being comprised of unit operations repeated a specified number of times, each of the unit operations including an operation that moves the backrest into a second sloping position from a first sloping position and afterwards moves the backrest into a third sloping position, the first, second and third sloping positions of the stretching operation being included in the different sloping positions, each second sloping position of the stretching operation having an inclination larger than the first sloping position in the same unit operation with respect to the vertical direction, each third sloping position of the stretching operation having an inclination smaller than the second sloping position in the same unit operation with respect to the vertical direction, an angle between a series of first and second sloping positions being smaller than an angle between succeeding series of first and second sloping positions.

4. The massage chair of claim 3, further comprising left and right armrests, wherein the left holding mechanism comprises:

a left cover that is located above the left armrest and covers the at least left forearm;

at least one first airbag located at the left armrest and/or the left cover;

and an air supply pump for swelling the first airbag wherein the right holding mechanism comprises:

a right cover that is located above the right armrest and covers the at least right forearm;

at least one second airbag located at the right armrest and/or the right cover; and said or another air supply pump for swelling the second airbag, and wherein the controller swells the first airbag through the air supply pump to hold the at least left forearm with the first airbag, the left armrest and the left cover when holding the at least left forearm, and also swells the second airbag through the air supply pump to hold the at least right forearm with the second airbag, the right armrest and the right cover when holding the at least right forearm.

5. The massage chair of claim 4, wherein in each unit operation of the stretching operation, the controller holds the at least left forearm with the first airbag, the left armrest and the left cover and then increases holding force by the first airbag as allowing the electric reclining mechanism to move the backrest from the first sloping position to the second sloping position in the existing unit operation; and also holds the at least right forearm with the second airbag, the right armrest and the right cover and then increases holding force by the second airbag as allowing the electric reclining mechanism to move the backrest from the first sloping position to the second sloping position in the existing unit operation.

6. The massage chair of claim 1, wherein the holding mechanism comprises left and right covers, wherein the controller is configured to move the left and right covers into a predetermined angle to lock the left and right covers, before said warm-up and said arm stretch.

* * * * *